United States Patent [19]

Ridgley et al.

[11] Patent Number: 4,545,474

[45] Date of Patent: Oct. 8, 1985

[54] MOUNTING MEANS AND METHOD OF AFFIXING A DROP COIN MECHANISM

[75] Inventors: James R. Ridgley; Bruce L. Reeder, both of Frederick, Md.

[73] Assignee: North American Philips Corporation, New York, N.Y.

[21] Appl. No.: 501,931

[22] Filed: Jun. 7, 1983

[51] Int. Cl.[4] ..... G07F 1/04

[52] U.S. Cl. ..... 194/1 E; 194/1 K

[58] Field of Search ..... 194/1 A, 1 E, 1 R, 1 L, 194/1 B, 92, 9, 10, 55, 1 K; 220/315

[56] References Cited

U.S. PATENT DOCUMENTS

| | | | |
|---|---|---|---|
| 3,295,650 | 1/1967 | Hall | 194/1 E |
| 3,372,783 | 3/1968 | Reedy, Jr. | 194/1 K |
| 3,905,460 | 9/1975 | Greenwald et al. | 194/1 B |
| 3,927,750 | 12/1975 | Greenwald et al. | 194/1 A |
| 3,977,506 | 8/1976 | McNally | 194/55 |

*Primary Examiner*—Stanley H. Tollberg
*Attorney, Agent, or Firm*—Robert S. Smith

[57] ABSTRACT

A combination of first and second plates adapted to sandwich between them a panel to which they are to be affixed. The first plate has at least one boss projecting from one face thereof, and first threaded structure spaced from the boss. The boss defines a lip spaced from the face, at least part of the lip being directed generally toward the first threaded structure. The second plate defines a first edge adapted to be received under the lip, and a second edge adapted to lie adjacent the first threaded structure. The combination further includes a second threaded structure for engagement with the first threaded structure, the second threaded means having a portion adapted to bear against the second edge of the second plate.

6 Claims, 10 Drawing Figures

PRIOR ART

MOUNTING MEANS AND METHOD OF AFFIXING A DROP COIN MECHANISM

This invention relates generally to a combination of components adapted to affix a mechanism or the like to a panel which may be part of a machine. More specifically, this invention provides means by which a mechanism such as a drop coin mechanism may be retrofitted to a coin-operated machine such as a washer or dryer, to replace a standard coin slide mechanism. However, it will be appreciated from what follows that the invention provided herein can be utilized not only for retrofitting mechanisms on existing machines, but for securing any component against one face of a machine panel, whether it be retrofitted or originally installed.

BACKGROUND OF THE INVENTION

This invention will be described with particular reference to the retrofitting of a drop coin mechanism on a coin-operated machine such as a washer or dryer, in place of the typical coin slide mechanism with which such machines are conventionally provided. For this reason, it is appropriate to discuss the reasons why such retrofitting with a drop coin mechanism is desirable.

Conventional coin slide mechanisms are subject to numerous problems and require maintenance on a regular basis. The coin slide mechanism is one in which a coin, for example a quarter, is placed horizontally into a circular recess in a slide portion with the slide pulled fully out, whereupon the slide is pushed inwardly to carry the coin into the machine where it is discharged through a coin chute into a coin collecting box. If a coin of improper thickness or diameter is placed into the recess, it is not possible to push the slide in. However, because of the construction of the coin slide mechanism, jamming often results. Jamming can result if a slug or foreign coin is placed into the recess, and the user attempts to force the slide inwardly. Similarly, the placing of any foreign object into the recess, and even dirt or paper scraps, can cause jamming.

Jamming for any of these reasons naturally results in "down time" for the machine, and requires servicing. In laundromats or in apartment laundry rooms, the necessity of shutting one or more machines down for servicing represents lost revenue, and is something which the owner or proprietor of the laundry facility would wish to minimize.

There is presently available a mechanism which will be called herein a "drop coin mechanism" and which does not utilize a coin slide which is capable of jamming. Instead, the user simply inserts the appropriate coin (for example a quarter) into the entry slot, and the internal mechanism is able to distinguish a true quarter from slugs or coins of other denominations, any of which are returned through the coin return slot. This mechanism discriminates primarily on the basis of weight and diameter. The mechanism can also incorporate a magnetic means for trapping ferromagnetic coins or slugs in countries where the intended coin is non-magnetic.

Because none of the moving parts of the drop coin mechanism is manipulated by or accessible to the user of the machine, there is no danger of jamming, improper use of vandalism. As a result, if it were possible to readily replace the existing coin slide mechanisms with such drop coin mechanisms in laundromat washers and dryer, normally called "commerical machines", positive gains could be effected in terms of reduced down time and servicing requirements.

In the past, studies have been made by manufacturers of washers and dryers, in an attempt to determine whether a drop coin mechanism could readily be retrofitted to an existing washer or dryer equipped with a coin slide mechanism. However, these studies failed to show that such retrofitting could easily be done, in view of the fact that the vertical dimension of the drop coin mechanism is too great to allow it to be inserted through the opening which remains when the coin slide mechanism has been removed.

Another disadvantage of a slide-equipped commercial washer or dryer relates to the complexity and difficulty of changing the price of operating the machine. In a coin slide mechanism, the slide is normally equipped with from one to three circult recesses for receiving quarters or other coins. All of the recesses must be filled with the appropriate coin in order to allow the slide to be pushed in and initiate operation of the machine. Thus, to change the price of the machine requires changing the entire slide mechanism to one which has a different array of recesses for coins. This alteration is time consuming and costly, and an advantage would result if it could be avoided.

SUMMARY OF THE INVENTION

It is accordingly an aspect of this invention, in its broadest context, to provide a method by which a drop coin mechanism can be retrofitted easily to the meter box of a slide-equipped, standard commercial washer or dryer.

A futher aspect of this invention is to provide an attachment means by which a plate, for example one having a drop coin mechanism attached thereto, may be affixed to a panel. In the case of a commercial washer or dryer, the panel would be an external panel of the meter box of the machine. Yet a further aspect of this invention is to allow the price of operating a commercial washer or dryer to be changed easily and quickly, and this is done by providing, in place of the coin slide mechanism, a drop coin mechanism in which a microswitch is capable of counting one or more coins as they fall through the mechanism into the coin collection box. Normally, a drop coin mechanism is used in conjunction with solid state circuitry which includes a denomination selector chip having a "dip switch", which is merely a short-circuiting contact piece that can be moved to any of several pairs of upstanding contacts. This simply tells the counter in the circuitry how many coins it must count before allowing the machine to start.

Accordingly, in one form, this invention provides a method of retrofitting a drop coin mechanism to the interior of the meter box of a washer or dryer, the meter box being initially fitted with a coin slide mechanism, and having an access panel to its interior, the access panel closing an access opening. The method includes first removing the access panel, and then removing the coin slide mechanism. Then, the drop coin mechanism is inserted into the interior of the meter box through the access opening and is affixed to the inside face of an outside panel of the meter box from within the meter box.

This invention further provides the combination of a first and second plate which are adapted to sandwich between them a panel to which they are to be affixed. The first plate has at least one boss projecting from a face thereof, and first threaded means spaced from the boss. The boss defines a lip spaced from the face of the first plate, at least part of the lip being directed generally toward the first threaded means. The second plate defines a first edge adapted to be received under the lip, and a second edge adapted to lie adjacent the first threaded means. The combination further includes a second threaded means for engagement with the first threaded means, the second threaded means having a portion adapted to bear against the second edge of the second plate.

There is further provided a method of affixing a drop coin mechanism to a panel of a coin-operated machine. The drop coin mechanism includes a mounting plate through which are provided a coin insertion slot and a coin return slot. The method includes first providing an outer plate with at least one boss projecting from one face thereof, and first threaded means spaced from the boss. The boss defines a lip spaced from the one face of the outer plate, at least part of the lip being directed generally toward the first threaded means. The outer plate has slots for registry with the slots of the mounting plate. Next there is provided on the mounting plate a first edge adapted to be received under the lip, and a second edge adapted to lie adjacent the first threaded means. It is ensured that the panel has recesses or removed portions for registry with the slots, with the boss and with the threaded means. Then, the outer plate is placed against one face of the panel with the boss projecting across the panel, and the mounting plate is placed against the other face of the panel with the first edge received under the lip and the second edge lying adjacent the first threaded means. Finally, a second threaded means is engaged with the first threaded means to bring a portion of the second threaded means into bearing engagement with the second edge of the mounting plate.

BRIEF DESCRIPTION OF THE DRAWING

One embodiment of this invention is illustrated in the accompanying drawings, in which like numerals denote like parts in all figures, and in which.

DESCRIPTION OF THE PREFERRED EMBODIMENTS

Figure 1:
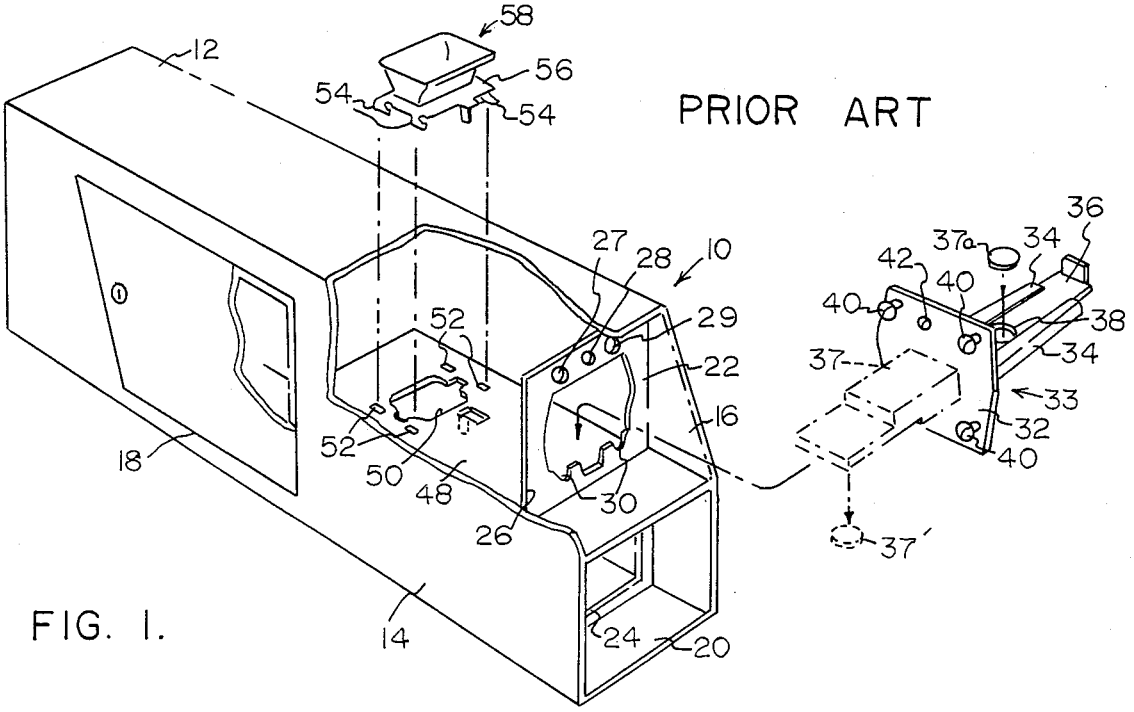
FIG. 1 is a a partly broken-away, perspective view of a meter box normally forming part of a typical laundromat washer or dryer, in which a side access panel is provided.

Attention is first directed to FIG. 1, which shows a meter box 10 having a top wall 12, two side walls 14 and 16, an access panel 18 in the slide wall 14, a bottom wall 20, a mounting panel 22 and a coin access panel 24.

The mounting panel 22 is provided with a side 26 and apertures 27, 28 and 29.

The panel 22 includes an opening having pockets 30, 30. The apertures 27 and 29 and the pockets 30 are located substantially at the corners of a hypothetical rectangle in order to register with similarly placed fastening means on a mounting plate 32 of a coin slide mechanism 33 in FIG. 1. The coin slide mechanism 33 includes, in addition to the mounting plate 32, guideway members 34 and a coin slide 36 reciprocating within the members 34. Structure 37 is located on the other side of the mounting plate 32 (closest to the observer in FIG. 1), but need not be described in detail as it is conventional and does not form any part of the present invention. In the normal operation of the coin slide mechanism 33, a coin 37*a* is placed into a circular recess 38 in the slide 36, and the latter is pushed inwardly to carry the coin across the position of the mounting plate 32 to a release position where it falls out, as shown in broken lines at 37' in FIG. 1.

The mounting plate 32 of the coin slide mechanism 33 is provided with four threaded fasteners 40 with heads (only three visible in FIG. 1), all projecting inwardly from the mounting plate 32. These four fasteners are adapted to register in the apertures 27, 29 and pockets 30 of the mounting panel 22 forming part of the meter box 10. Before insertion, the fasteners 40 are adjusted so that their heads tightly fit inside the lower edges of the apertures 27, 29 and the pockets 30. The mounting plate is then pushed inwardly and slipped downwardly against the panel 22, whereupon the aperture 28 becomes aligned with a threaded bore 42, and a threaded member (not shown) is engaged through both.

The meter box 10 has an intermediate horizontal panel 48 in contact with the bottom edge of the mounting panel 22 and with the top edge of the panel 24. The panel 48 has an opening 50 through which the coin 37' can fall into a coin box under the panel 48, and also has a plurality of slots 52 for receiving suitable tabs 54 on the base plate 56 of a coin chute 58.

Figure 2:
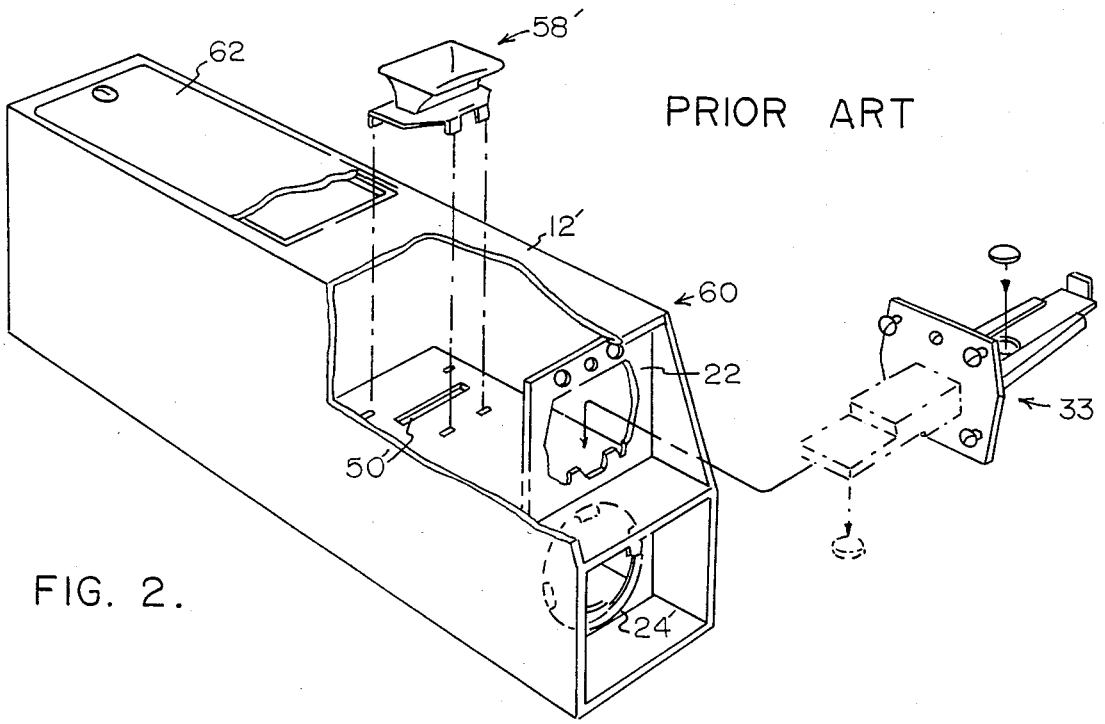
FIG. 2 is a partly broken-away, perspective view of a similar meter box, with a top access panel.

The prior art meter box 60 shown in FIG. 2 is similar to that shown in FIG. 1, and thus does not need to be described in as detailed a manner. The coin slide mechanism 33 in FIG. 2 is identical to the coin slide mechanism 33 in FIG. 1, as is the mounting panel 22, and the general configuration of the meter box. In the case of FIG. 2, the top wall 12' has a rectangular access plate 62, the panel 24' has a circular opening rather than a rectangular one as in FIG. 1, and the coin opening 50' is slot-like and extends transversely to the length of the meter box 60. The configuration of the chute 58' also differs slightly from the chute 58 in FIG. 1.

Apart from these minor differences, however, the connection of the coin slide mechanism 33 with the mounting panel 22 is identical to that already described with respect to FIG. 1.

Figure 3:
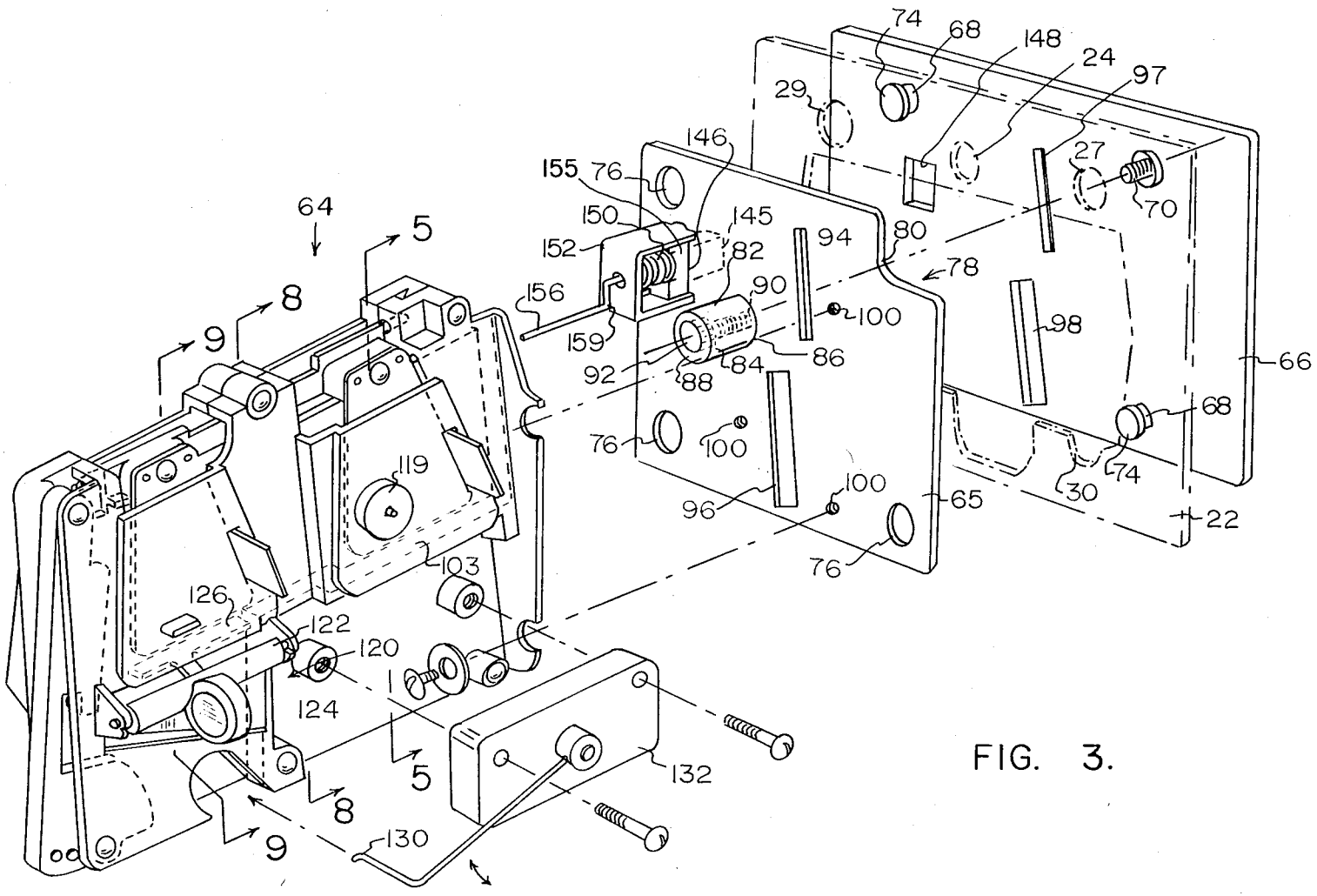
FIG. 3 is an exploded perspective view of a drop coin mechanism and two plate components of this invention.

Referring now to FIG. 3, there is shown a drop coin mechanism 64, a mounting plate 65 for the drop coin mechanism, the panel 22 which forms part of the meter box of either FIG. 1 or FIG. 2, and an outer plate 66.

The structure and functioning of the drop coin mechanism 64, which is conventional, will be briefly described subsequently with the aid of FIGS. 4–10. First, however, attention is directed to the right portion of FIG. 3, which specifically illustrates the mounting means.

As can be seen, the outer plate 66 and the mounting plate 65 are adapted to sandwich between them the panel 22. In essence, the mounting plate 65, with the drop coin mechanism 64 attached to it, is to be firmly affixed to the inner face of the panel 22, and the outer plate 66 plays an important part in the attachment procedure. The outer plate 66 is substantially rectangular, and has three bosses 68 projecting from the nearer face 69 thereof. In FIG. 3 only two of the bosses 68 can be seen, the third being located adjacent the corner of the outer plate 66 which is hidden by the mounting plate 65. The outer plate 66 also has a first threaded means spaced from all of the bosses 68. More particularly, the first threaded means of the outer plate 66 is a threaded stub shaft 70 integral with a mounting disc 72, the combination being firmly affixed to the outer plate 66, for example by riveting or welding.

Each boss 68 has, at its end remote from the inner face 69 of the outer plate 66, a circular head 74, the circular head 74 having a larger diameter than the boss 68, and thus defining an overhanging lip projecting outwardly from the boss 68 around its periphery. Each lip 74 projects in all directions from its respective boss 68, and thus a portion of each lip is directed generally toward the stub shaft 70. Boss 68 could be adjustable to allow for fitting and tolerance built-ups.

The mounting plate 65 is provided with three openings 76 at three corners of a hypothetical rectangle, in positions to simultaneously receive the three bosses 68. More specifically, each opening 76 has a larger lower portion sized to receive the head 74 of the respective boss 68, and a smaller upper portion sized to receive the boss 68 itself but too small to allow the head 74 to pass. Thus, each opening 76 is somewhat egg-shaped or keyhole-shaped, for a purpose to be described.

Each opening 76 is adapted to be received under the lip defined by a respective head 74 of a respective boss 68, and this is accomplished by passing the respective boss into the opening and then slightly shifting the position of the mounting plate 65 so that an edge of the respective aperture slips under the respective head 74.

The mounting plate 65 also has a cutaway portion 78 at a corner proximate to the stub shaft 70, the cutaway portion 78 defines a further edge adapted to lie adjacent the threaded means defined by the stub shaft 70.

The inventive combination further includes a second threaded means for engagement with the first threaded means, and more particularly the second threaded means is a nut member 82 having a cylindrical outer portion 86, and flat ends 88 (only the nearest end is visible in FIG. 3). The nut has an internally threaded bore 90, and has a hexagonal recess 92 at the other end. The hexagonal recess 92 is adapted to receive a hexagonal wrench.

The threaded bore 90 is adapted threadedly to engage the stub shaft 70. Interference between the threaded bore 90 and the edge 80 prevents rotation of the plate 65.

As can be seen in FIG. 3, the mounting plate 65 has an oblique coin insertion slot 94 in its upper portion, and an oblique coin return slot 96 in its lower portion. Likewise, the outer plate 66 has slots 97 and 98 adapted to register with slots 94 and 96, respectively.

The mounting plate 65 has threaded bores 100 adapted to receive threaded fastening means for attaching the drop coin mechanism 64 to the mounting plate 65.

The panel 22, forming part of the meter box of the coin-operated machine, is normally provided with the configuration shown in broken lines in FIG. 3, which configuration is particularly adapted to the attachment of the conventional coin slide mechanism shown at 33 in FIGS. 1 and 2. More particularly, the panel 22 is provided with openings 27 and 29 spaced apart at the top, these being egg-shaped, and a large central recess 26 having downwardly extending pockets 30 (only one visible in FIG. 3). As previously pointed out, the apertures 27, 29 and the pockets 30 are located at the corners of a hypothetical rectangle, and for purposes of retrofitting the drop coin mechanism 64 against the panel 22, the positions of the bosses 68 and stub shaft 70, and the corresponding positions of the openings 76 and edge 80 on the mounting plate 65, are made to match these locations on the panel 22. Thus, there is no necessity for punching or drilling new openings in the panel 22 in order to permit the retrofitting of the drop coin mechanism 64.

In some instances, it may be necessary to cut certain portions from the panel 22 in order to accommodate the slots 94/97 and 96/98, and allow coins to be inserted or returned through these slots.

Attention is now directed to FIGS. 3–10, for a brief description of the structure and functioning of the drop coin mechanism 64, which is conventional as previously pointed out.

Generally speaking, the drop coin mechanism 64 provides a downward and inward path from the coin insertion slots 94, 97, and a downward and outward path back to the return slots 96, 98. Looking at FIG. 4, the downward and inward path is shown at 103, and the downward and outward path is shown at 105. These two paths form a kind of triangle, so that a coin which is rejected by the mechanism will run inwardly and downwardly along the path 103, and then will be returned along the path 105. The inward path 103 is defined by a rightward component 107 seen in FIG. 4, while the return path 105 is defined by as leftward component 108 seen in FIG. 4. Between these components is a pivoting flap 110 that acts as a reject flap to sweep a coin onto the reject path 105. The flap 110 defines an internal lower edge 112 which is spaced in parallel fashion above the entry path 103 at a distance such that a coin of the proper diameter will contact the edge 112 in a slightly overlapping manner, whereas a coin which is too small will "fall through" the window defined between the edge 112 and the path 103.

Figure 8:
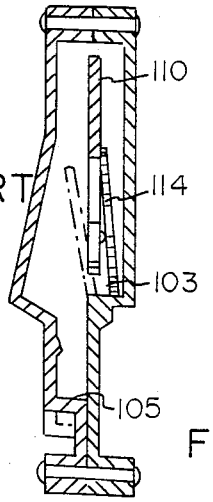
FIG. 8 is a sectional view taken at the line 8—8 in FIG. 3.

In FIG. 8, a coin of the proper diameter is shown at 114, and is prevented from falling through the window by contact with the flap 110. However, a smaller coin, shown in broken lines at 116 will fall through the window and enter the reject chute above the return path 105.

Figure 9:
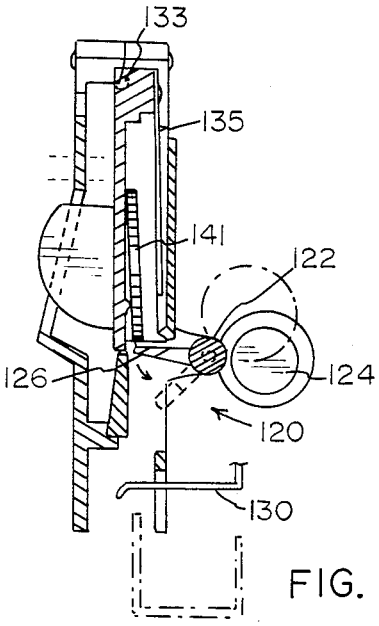
FIG. 9 is a sectional view taken at the line 9—9 in FIG. 3.

Before a coin reaches the window defined between the edge 112 and the entry path 103, it moves past a location where, if desired, a magnet 119 is located. The purpose of the magnet 119 is to capture slugs or coins made of ferro-magnetic material, in cases where the proper coin is non-magnetic. If a coin manages to get past the magnet, and also past the window defined between the edge 112 and the entry path 103, then the coin reaches a "weigh scale" where, if it is above a minimum weight, it will pass through the weigh scale and into the outlet chute, at the same time tripping a coin receipt microswitch. This is illustrated in FIGS. 3 and 9. A weigh balance seen at 120 includes a pivot post 122, an eccentric weight 124 and a trip lever 126. As seen in FIG. 9, the coin at the end of its inward travel ends up on the lever 126. If it has the appropriate weight, it will trip the balance by rotating the same in counter clockwise direction as seen in FIG. 9, and will fall through an outlet chute 128, at the same time contacting the trip wire 120 of a microswitch 132 (see FIG. 3). The microswitch 132 then sends the appropriate signal to the operating circuit of the machine, so that operation can commence.

Figure 4:
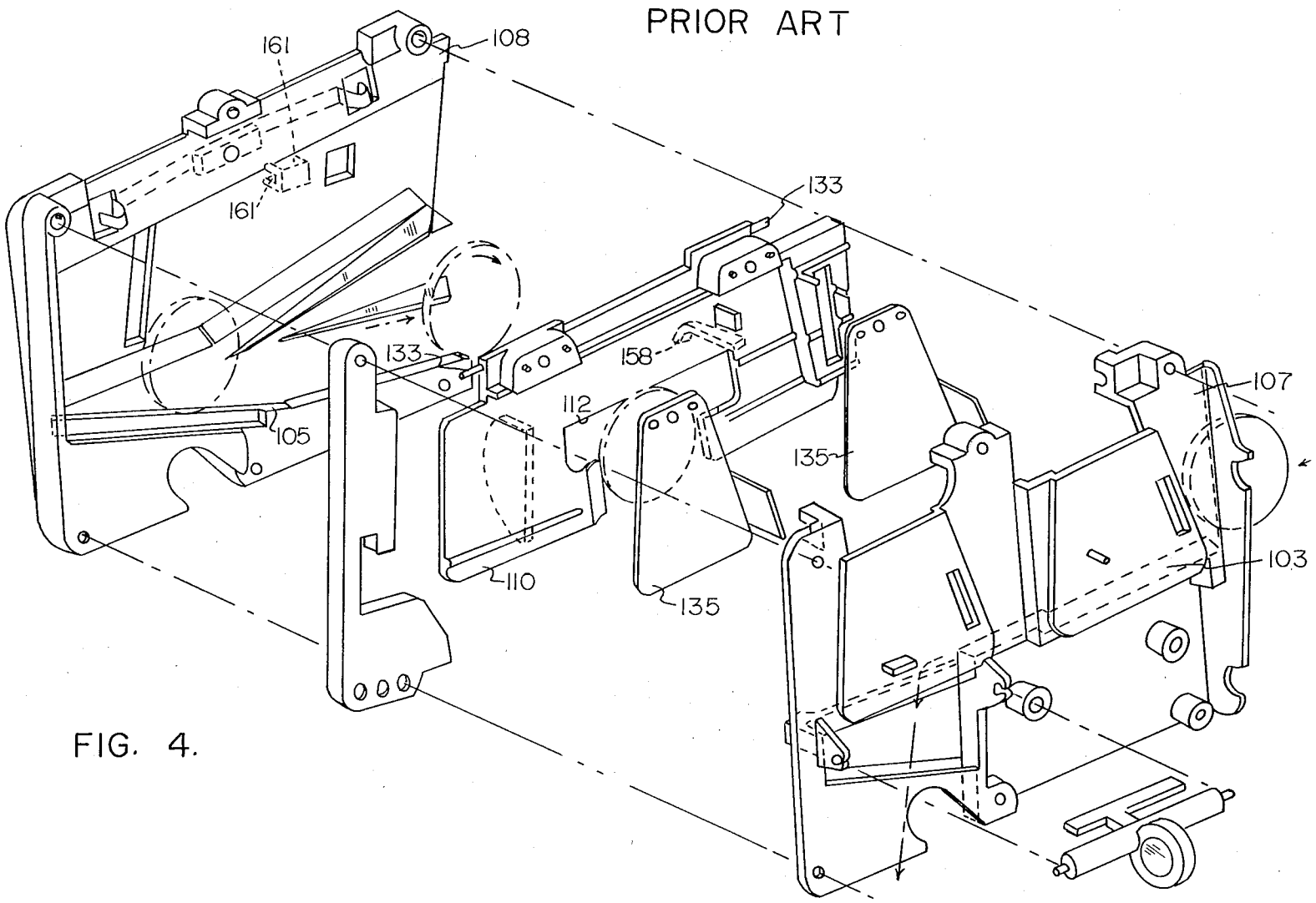
FIG. 4 is an exploded view of a conventional drop coin mechanism.
Figure 5:
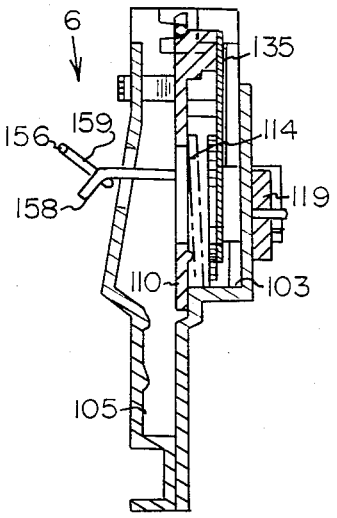
FIG. 5. PRIOR ART
FIG. 5 is a sectional view taken at the line 5—5 of FIG. 3.
Figure 10:
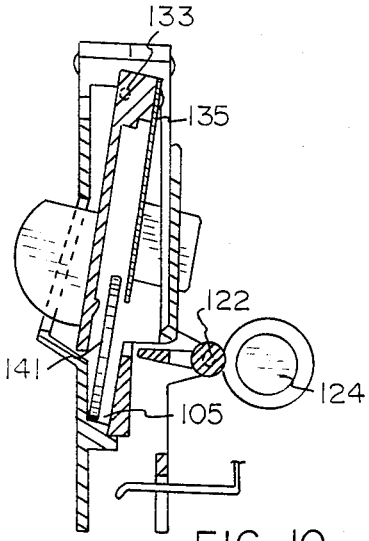
FIG. 10 is a sectional view similar to FIG. 9, but showing a light-weight coin being swept into the reject slot.

In any case where a coin fails to arrive at the end of the entry chute and to trip the balance 120, a "reject operation" can be carried out in which the coin is pushed or "swept" into the reject path 105. This is done by causing the flap 110 to pivot in the clockwise direction about its upper pivot axis, defined by posts 133. The flap 110 actually defines the leftward side of the entry path, as best seen in FIG. 5, but the flap 110 has affixed to it two sweep members 135 (see FIGS. 4, 5, 7, 9 and 10) which are spaced rightwardly from the flap 110 and which define the right margin of the entry path, as seen in the direction of FIG. 5. In FIG. 4, the rightward sweep member 135 is adapted to sweep into the return path 105 any coin or slug which is captured by the magnet 119. The leftward sweep member 135 is adapted to sweep into the return path 105 any coin which arrives at the balance 120, but which is not heavy enough to trip the balance. Such a coin is shown at 141 in FIG. 9, and FIG. 10 shows the leftward sweep member 135 sweeping the coin 141 onto the return path 105. A coin return button, shown in FIG. 3 in broken lines at 145, projects through a rectangular opening 146 in the mounting plate 65 and through a similar opening 148 in the outer plate 66. The coin return button 145 is spring-biased outwardly by a coil spring 150, the inner end of which is retained by a bracket 152 secured to the mounting plate 65. The coin return button 145 is integral with a larger inner portion 155, that prevents the coin return button 145 from being dislodged through the openings 146 and 148. Attached to the coin return button 145 is an activation wire 156 which engages a cam follower 158 shown in broken lines in FIG. 4, the cam follower 158 being integral with the flap 110. As can be seen in FIG. 3, the wire 156 has a dog-leg bend 159, which defines a cam adapted to exert leftward pressure against the cam follower 158 when the coin return button 145 is depressed inwardly from the outside of the outer plate 66. It is this motion which causes the flap 110 to pivot. The free end of the wire 156 is retained in a slot defined by two flanges 161 integral with the member 108 (see FIGS. 4 and 6).

Figure 6:
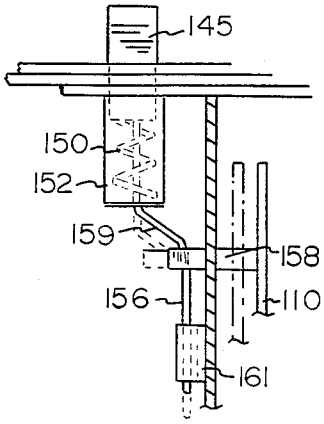
FIG. 6. PRIOR ART
FIG. 6 is a view from above looking along the arrow "6" at FIG. 5.
Figure 7:
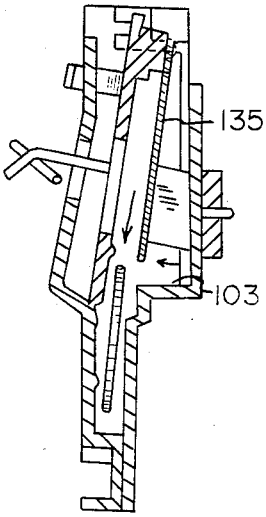
FIG. 7. PRIOR ART
FIG. 7 is a sectional view similar to FIG. 5, but shows a sweep action to reject a coin.

FIGS. 5, 6 and 7 are illustrative of the operation of the coin return button 145.

It is believed that no further detailed description of the drop coin mechanism is required, since this is a conventional mechanism forming part of the prior art.

It is thus evident that the method of retrofitting a drop coin mechanism to an existing coin-operated machine, such as a washer or dryer, equipped with a coin slide mechanism such as that shown at 33 in FIG. 1 involves several steps. The first step is to provide the outer plate 66 as shown in FIG. 3 and described above. Then, the mounting plate of a drop coin mechanism 64 is provided with openings 76 to match the bosses 68, and a particular edge (the edge 80) which is adapted to lie adjacent the threaded stub shaft 70. Then, it is ensured that the panel 22 does not interfere with the slots 94, 97 and 96, 98, or with the bosses 68 and stub shaft 70. The access panel 18 or 62 of a meter box is removed, along with the chute 58 or 58', and then the drop coin mechanism, including the mounting plate 65, is inserted into the interior thereof. Prior to insertion, it may be necessary to enlarge or re-orient the coin opening 50, 50'. The outer plate 66 is then placed against the outer face of the panel 22 with the bosses projecting across the panel 22 (i.e. through the apertures 27, 29 and pockets 30), following which the mounting plate 65 is placed against the inside face of the panel 22 with the openings 76 registering with the bosses 68, and the edge 80 lying adjacent the threaded stub shaft 70. Then, the second threaded means, i.e. the nut member 82, is engaged with the threaded stub shaft 70 in order to bring an interference between the threaded bore 90 and the edge 80 prevents rotation of the palte 65.

It should be realized that the openings 76 could be replaced by an open edge similar to the edge 80 in the upper right-hand corner of the mounting plate 65, since the main function of the openings 76 is to provide an edge adapted to engage under the lip defined by the circular head of the respective boss 68. Moreover, it is not essential for the lip defined by the circular head 74 of a boss 68 to extend all the way around the boss 68. The operative portion of the lip is that which is directed generally toward the stub shaft 70, and therefore the boss need only define that particular portion of the lip to be operative. Further, it should be realized that, while three bosses 68 and three openings 76 have been illustrated, it is conceivable that this invention could operate with two or even one boss/opening combination, along with the stub shaft 70 and the nut member 82. Finally, it should be recognized that the stub shaft 70 and the nut member 82 could be "reversed", in the sense that the first threaded means on the outer plate 66 could be a threaded bore, whereas the nut member 82 could in fact be a bolt-like member with a threaded shaft adapted to engage the threaded bore on the outer plate 66.

While a special embodiment of this invention has been illustrated in the accompanying drawings and described hereinafter, it will be evident to those skilled in the art that changes and modifications may be made therein without departing from the essence of this invention, as set forth in the appended claims.

We claim:

1. A method of affixing a drop coin mechanism to a panel of a coin-operated machine, the drop coin mechanism including a mounting plate through which are provided a coin insertion slot and a coin return slot, the method comprising the steps:

(a) providing an outer plate having at least one boss projecting from one face thereof, and first threaded means spaced from said boss, the boss defining a lip spaced from said one face, at least part of said lip being directed generally toward said first threaded means, the outer plate having slots for registry with the slots of the mounting plate, (b) providing on said mounting plate a first edge adapted to be received under said lip, and a second edge adapted to lie adjacent said first threaded means, (c) providing the panel with removed portions for registry with the slots, said at least one boss and said threaded means, (d) in any order:

(1) placing the outer plate against one face of the panel with said at least one boss projecting across the panel, (2) placing the mounting plate against the other face of the panel with said first edge received under said lip and said second edge lying adjacent said first threaded means, (e) engaging a second threaded means with said first threaded means to bring a portion of said second threaded means into bearing engagement with said second edge of the mounting plate.

2. The method claimed in claim 1, in which the step of providing a first edge on the mounting plate is accomplished by providing an opening in the mounting plate through which said at least one boss can pass.

3. In combination:

first and second plates adapted to sandwich between them a panel to which they are to be affixed, the first plate having at least one boss projecting from one face thereof, and first threaded means spaced from said boss, the boss defining a lip spaced from said one face, at least part of of said lip being directed generally toward said first threaded means, the second plate defining a first edge adapted to be received under said lip, and a second edge adapted to lie adjacent said first threaded means, the combination further including a second threaded means for engagement with said first threaded means, the second threaded means having a portion adapted to bear against said second edge of the second plate, said first edge of the second plate being disposed at the periphery of an opening in the second plate, the opening being large enough to receive said lip, the first plate having a plurality of said bosses, all spaced from said first threaded means, each boss being receivable in a respective opening in the second plate, the lip for each boss being defined by a generally circular head on the respective boss, each circular head having a larger diameter than the respective boss, each opening being non-circular, comprising a larger end sized to receive the head of the respective boss, and a smaller end sized to receive the boss only.

4. The combination claimed in claim 3, in which the second plate has a drop coin mechanism affixed thereto and has slots for coin insertion and coin return, the panel being part of a coin-operated machine, the first plate having slots for alignment with the slots in the second plate.

5. The combination as claimed in claim 2 in which the first plate has three bosses, and in which the three bosses and the first threaded means are respectively located substantially at the four corners of a rectangle.

6. A method of retrofitting a drop coin mechanism to the interior of the meter box of a washer or dryer, the meter box being initially fitted with a coin slide mechanism, and having an access panel to its interior, the access panel closing an access opening, the method including the steps:

(a) removing the access panel, (b) removing the coin slide mechanism, (c) inserting the drop coin mechanism into the interior of the meter box through the access opening, (d) and affixing the drop coin mechanism to the inside face of an outside panel of said meter box, from within the meter box by the following steps, (e) providing an outer plate having at least one boss projecting from one face thereof, and first threaded means spaced from said boss, the boss defining a lip spaced from said one face, at least part of said lip being directed generally toward said first threaded means, the outer plate having slots for registry with the slots of the mounting plate, (f) providing on said mounting plate a first edge adapted to be received under said lip, and a second edge adapted to lie adjacent said first threaded means, (g) providing the outside panel with removed portions for registry with the slots, said at least one boss and said threaded means, (h) in any order:

(1) placing the outer plate against one face of the panel with said at least one boss projecting across the panel, (2) placing the mounting plate against the other face of the panel with said first edge received under said lip and said second edge lying adjacent said first threaded means, (i) engaging a second threaded means with said first threaded means to bring a portion of said second threaded means into bearing engagement with said second edge of the mounting plate.

* * * * *